US006427447B1

(12) United States Patent
Sowa

(10) Patent No.: US 6,427,447 B1
(45) Date of Patent: Aug. 6, 2002

(54) BULKHEAD FOR DUAL FUEL INDUSTRIAL AND AEROENGINE GAS TURBINES

(75) Inventor: William Arthur Sowa, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 44 days.

(21) Appl. No.: 09/777,974

(22) Filed: Feb. 6, 2001

(51) Int. Cl.[7] ..... F02G 3/00
(52) U.S. Cl. ..... 60/737; 60/739; 60/742
(58) Field of Search ..... 60/737, 738, 739, 60/740, 742

(56) References Cited

U.S. PATENT DOCUMENTS 4,455,840 A * 6/1984 Matt et al. ..... 60/737
5,435,884 A 7/1995 Simmons et al.
6,240,732 B1 * 6/2001 Allan ..... 137/561 A
6,321,541 B1 * 11/2001 Wrubel et al. ..... 60/740

* cited by examiner

*Primary Examiner*—Ehud Gartenberg
(74) *Attorney, Agent, or Firm*—Bachman & LaPointe, P.C.

(57) ABSTRACT

An improved bulkhead for dual fuel industrial and aeroengine gas turbines, that may be formed by one or more bulkhead elements. Each element has a fuel-air channel, having an inlet for introducing air and an outlet for exiting a fuel-air mixture. Each element further includes at least one manifold for introducing a liquid or a gaseous fuel into the fuel-air channel. The channel and the manifold are formed by a plurality of etched layers of macrolaminate or platelet material. Each element may further include an air cooling channel for cooling the backside of the bulkhead. The bulkhead may be used in can and in annular combustors.

19 Claims, 6 Drawing Sheets

BULKHEAD FOR DUAL FUEL INDUSTRIAL AND AEROENGINE GAS TURBINES

BACKGROUND OF THE INVENTION

The present invention relates to an improved bulkhead design for use in combustors for dual fuel industrial and aeroengine gas turbines.

In a typical state-of-the-art gas turbine for either land based or aero applications, the combustor front end or bulkhead is comprised of several parts including but not limited to (1) a fuel nozzle where air and fuel are mixed together, (2) nozzle guide hardware to accommodate thermal growth and proper tolerancing to enable replacement of a fuel nozzle, (3) bulkhead structure providing mechanical strength and anchoring points for float wall panels and (4) float wall panels which are exposed to the flame and have adequate air cooling to be maintained well below critical material temperatures. In addition, each fuel nozzle must incorporate different levels of sophistication depending on the application. A land based gas turbine fuel nozzle, for example, must provide multiple fuel circuits that support fully premixed mode operation and piloting at part power as well as fuel circuits for gas and liquid fuel types. Managing all of these requirements for a typical engine can be complicated and lead to costly designs in the field or combustor designs that do not get full benefit of potential performance gains achieved by more costly approaches.

The emissions requirements from land based gas turbines are stricter than for aeroengines because the consequence of heavy or bulky control technology are less, i.e. aggressive emission control technologies can be used on ground devices without compromising weight or operability requirements. Moreover, regulation is done by local authorities resulting in a vast array of laws and requirements that an industrial gas turbine must meet. In general, however, industrial engines must produce less than 9 ppm NOx and 9 ppm CO corrected to 15% oxygen without direct water injection into the combustor while operating on natural gas to be competitive in the market place beyond the year 2000. This level of emissions would permit guaranteed emission levels of 15 ppm NOx and 15 ppm CO. Industrial engines must also be capable of running on liquid fuels, i.e. have dual fuel capability, to capture the largest share of the market place. The common practice for surface power gas turbines is to use a lean, premixed combustion strategy. Lean premixed combustion attempts to closely control the combustion temperature and composition, and thereby control NOx formation, UHC and CO oxidation process.

Premixed combustor components must be developed that achieve the required degree of fuel-air premixing without creating zones in the premixer where a flame can stabilize and without promoting a flame structure in the combustor that is prone to acoustic instability coupling, i.e. high levels of pressure fluctuations. The premixing device must be capable of operating over the entire operating range of the engine. This is challenging since the design point for premixing is near to the lean blowout (LBO) limit of the combustor. Therefore, as conditions change from the design point, the operating fuel-air ratio can drop below the associated LBO. Variable geometry air management, piloting schemes or fuel staging of the nozzle is required to maintain the flame fuel-air ratio above LBO while operating at most part power conditions.

Because industrial engines have operating cycles close to aeroengine operating cycles, and because they must operate on liquid fuels in addition to natural gas, they represent a natural technology demonstration platform in the process of developing new technology for aeroengines. In addition, the need for low cost, reliable parts is the same in industrial engines as it is in aeroengines.

The fabrication costs for industrial technology including fuel injector, nozzle guides and bulkhead pieces in some applications are roughly an order of magnitude higher than aeroengines.

Macrolaminate spray atomization technology has been on the market for the past five years from Parker Hannifin Corporation. U.S. Pat. No. 5,435,884 to Simmons et al., and assigned to Parker Hannifin, relates to a method of forming an atomizing spray nozzle which includes the steps of etching a swirl chamber and a spray orifice in a thin sheet of material. The swirl chamber is etched in a first side of the disk and the spray orifice is etched through a second side to the center of the swirl chamber. Feed slots are etched in the first side of the disk extending non-radially to the swirl chamber such that a liquid can be conveyed to the swirl chamber so as to create and sustain the swirling motion. An inlet piece with inlet passage therein is connected with the first side of the disk so as to convey liquid to the feed slots of the disk and to enclose the feed slots and swirl chamber. Macrolaminate atomizers have been shown to produce similar to better atomization relative to comparable traditional designs. This technology has been in production for Westinghouse industrial gas turbine engines. To date, however, this technology has not been applied to bulkhead design.

A similar competing technology has been introduced by Aerojet Incorporated and features platelet technology. Like macrolaminate technology, platelet technology can be used to create intricate passageways in structures that are built by layers of planar etched metals. Both technologies enable fuel-air passageway designs in structures that can efficiently and effectively replace current gas turbine combustor technology.

SUMMARY OF THE INVENTION

Accordingly, it is an object of the present invention to provide an improved bulkhead design for use in dual fuel industrial and aeroengine gas turbines.

It is a further object of the present invention to provide a bulkhead design which utilizes macrolaminate, platelet, or similar fabrication technology.

The foregoing objects are attained by the bulkhead design of the present invention.

In accordance with the present invention, a bulkhead for use in dual fuel industrial and aeroengine gas turbines is formed by one or more bulkhead elements. Each bulkhead element includes an air channel and at least one manifold for providing either liquid fuel in droplet form or gas fuel to the air channel to create a fuel-air mixture which is supplied to a combustion chamber. Each bulkhead element, including the air channel and the at least one liquid or gas fuel manifold, is formed by layers of etched material bonded together. Each bulkhead element also may include a cooling air channel for cooling a surface of the bulkhead element on the flame side of the bulkhead. In a preferred embodiment of the present invention, two sets of liquid or gas manifolds supplied by two different liquid or gas fuel plenums are provided in the bulkhead to allow two levels of fuel staging.

Other details of the bulkhead design of the present invention, as well as other objects and advantages attendant thereto, are set forth in the follow detailed description and the accompanying drawings wherein like reference numerals depict like elements.

DETAILED DESCRIPTION OF THE PREFERRED EMBODIMENT(S)

Fabrication processes like macrolamination or platelet technology use relatively thin sections of etchable structural material that can be layered and bonded together to create intricate passageways in the final product. Each material layer is chemically etched to create the desired flow pathways in much the same manner that intricate electrical circuits are designed into integrated circuit chips. Each laminate sheet can range in thickness from 0.015–0.040 inches. After each layer has been processed, the layers may be bonded together either through brazing or diffusion bonding.

Compared to traditional atomizer fabrication methods that involve turning barstock and milling, EDMing, or electrochemical milling of slots, macrolaminate atomizers can be manufactured more than 100 at a time from a single laminate sheet. This ability to create so many atomizers in a single sheet underscores the possibility to not only create the atomizers but also the cooling air passages and other bulkhead requirements in a single sheet. This is a potential significant cost savings through part count reduction and fabrication step reduction. The multipoint fuel and air introduction feature represents a significant advantage to achieve ultra low emissions. For fuel lean combustor systems, like those used in industrial power, this means that the injector and mixing length scales will be greatly reduced resulting in high levels of premixing in short residence times. The high quality premixing lowers NOx emissions. Using bulkhead cooling air as combustion air lowers CO emissions. The short mixing time helps premixer robustness by providing greater autoignition delay time margin.

Modern gas turbine engine combustors are usually provided with an upstream end wall or bulkhead which extends radially between inner and outer wall members. The bulkhead is provided with a plurality of apertures, each of which receives an air-fuel injection device for introducing a mixture of air and fuel into the combustion chamber during engine operation.

Figure 1:
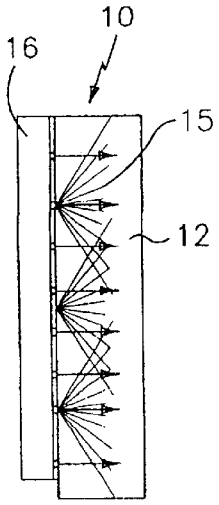
FIG. 1 is a top view of a portion of a bulkhead element in accordance with the present invention.
Figure 2:
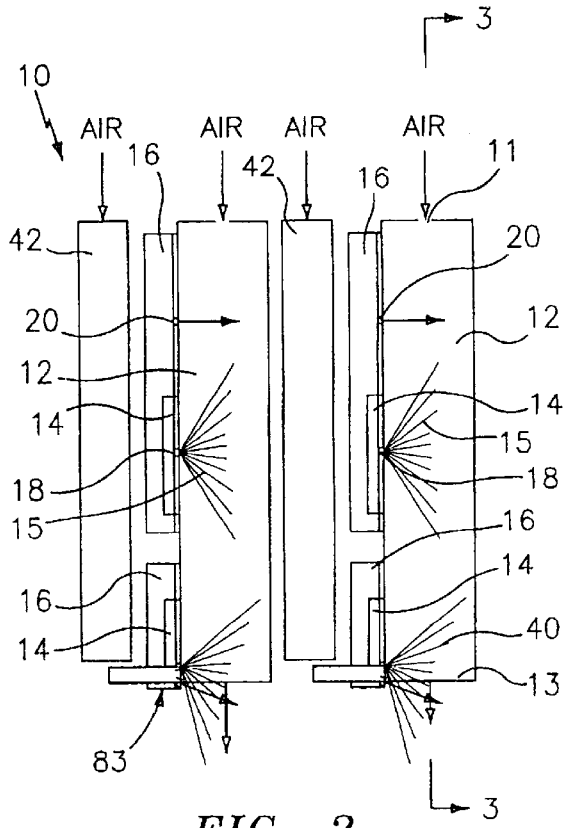
FIG. 2 is a side sectional view of two bulkhead elements.
Figure 3:
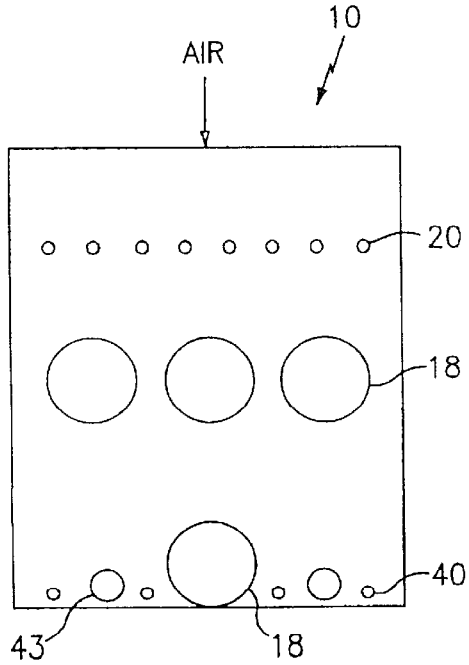
FIG. 3 is a sectional view of a bulkhead element of FIG. 2 taken along lines 3—3.
Figure 4:
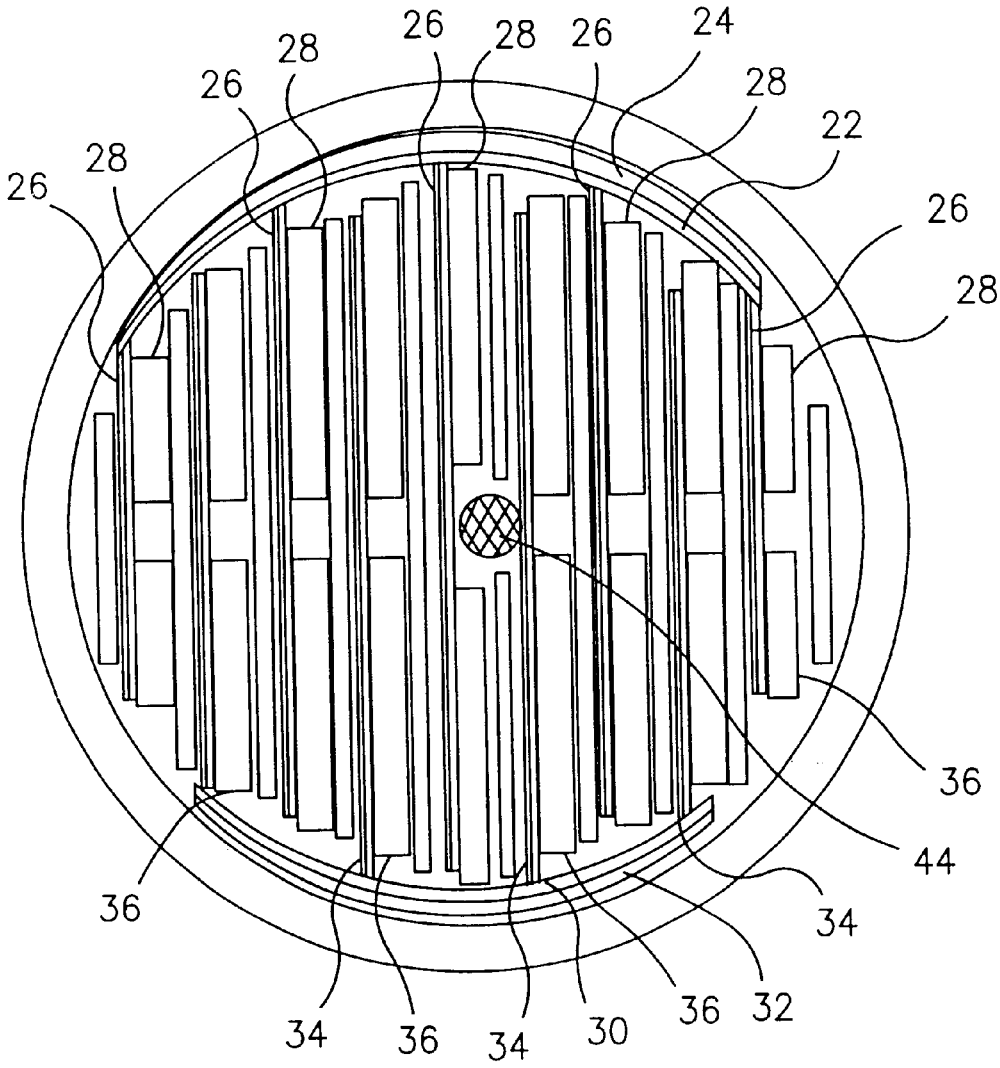
FIG. 4 is a sectional view of a bulkhead design arranged for a can combustor having two levels of fuel staging.
Figure 8:
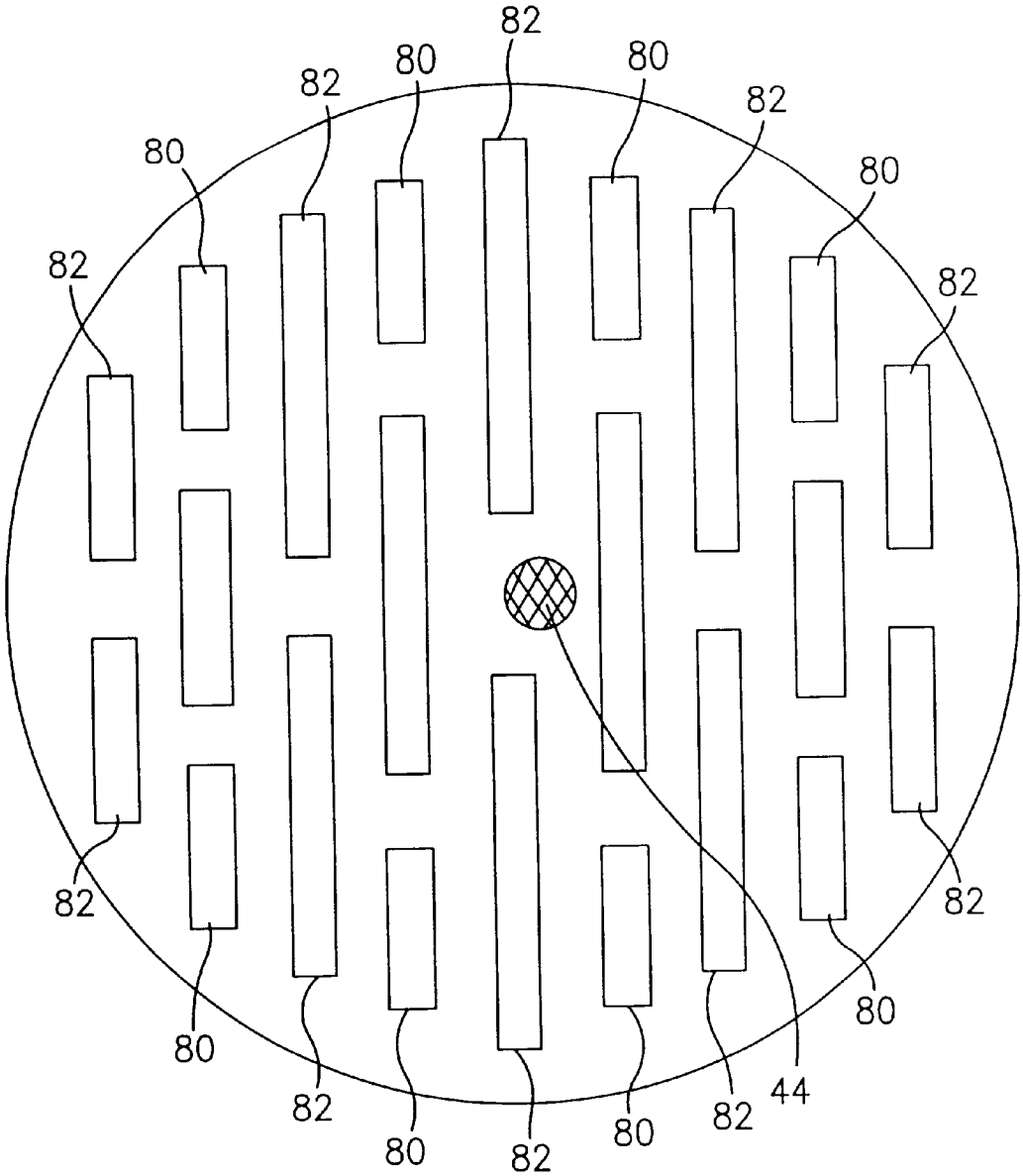
FIG. 8 is a bottom cross sectional view of a mixing chamber layout arranged for a can combustor with staggered fuel staging to allow interaction between like staged elements.

FIGS. 4 and 8 illustrate a portion of a bulkhead that is appropriate for a can combustion system. As will be shown hereinafter, this bulkhead concept can be easily extended to annular combustors as well. The bulkhead is the surface on the inside of the combustor through which the fuel and air reactants enter the combustion chamber. The bulkhead is formed by a number of macrolaminate bulkhead elements 10 as depicted in FIGS. 1–3. Each bulkhead element 10 includes a channel 12 having an opening 11 at the top through which air enters and an exit opening 13 at the bottom. The channel 12 can be either rectangular in cross section or of different geometry. As the air passes through the channel 12 from the inlet 11 to the exit 13, it is exposed to cross streams extending in from 0–180 degrees where 90 degrees is perpendicular to the cross flow 15 of fuel and becomes mixed therewith. The variation in cross flow angle can also be rotated. The resulting fuel-air mixture exits into the combustion chamber (not shown) of a combustion system where the fuel-air mixture is burned.

When using liquid fuel, each bulkhead element 10 is provided with one or more liquid fuel manifolds 14 which provide the liquid fuel for the fuel-air mixture. Each liquid fuel manifold 14 is preferably arranged to fall inside of a second channel 16 which can be used as a gaseous fuel manifold or simply as a thermal barrier to protect the liquid fuel from coking. As previously mentioned, the liquid fuel manifold(s) 14 feed atomizers 18 that provide an array of fuel droplets to the cross flow of air in channel 12.

When the combustion system is also being operated with a gaseous fuel or using both liquid and gaseous fuels, the second channel 16, acting as the gas manifold, feeds an array of orifices 20 that cause gas fuel jets to interact with the air cross flow in the channel 12.

As shown in FIGS. 2 and 3, each fuel-air mixing channel 12 is provided with liquid and gas pilots 40. The pilots 40 provide turndown capability and light-off capability. This aspect of the present invention may be optional in those embodiments where a turn down might be sufficient to provide adequate conditions to promote ignition and low power operation.

As shown in FIG. 2, each fuel-air mixing channel has a neighboring air cooling access channel 42 for providing cooling air, for example backside impingement, to the bulkhead surface that is exposed to the flame. The cooling air passes through the access channel 42, cools the backside of the flame exposed surface of the bulkhead, and then exits the bulkhead 10 via discharge 43 and the exit 13 of the fuel-air mixing channel 12. Discharging the cooling air in this location allows it to be partly mixed into the fuel-air stream as it passes into the combustion chamber. However, designs are also possible where the cooling air is discharged directly through the bulkhead 83 without entering the air mixing channel 12.

For reasons be discussed hereinafter, it is preferred that the bulkhead-include staged air-fuel mixing channels. As shown in FIG. 4, a bulkhead may be designed that has a first liquid plenum 22 positioned inside a first gas plenum 24. The liquid plenum 22 is connected via lines 26 to a plurality of liquid manifolds which communicate with a first set of air channels to form a first fuel-air stage 28. If desired, the gas plenum 24 may also be connected to the air channels in the first set. The bulkhead may also be designed to have a second liquid plenum 30 positioned inside a second gas plenum 32. The second liquid plenum 30 is connected via lines 34 to a second set of liquid manifolds which communicate with a second set of air channels to form a second fuel-air stage 36. If desired, the gas plenum 32 may also be connected to the air channels in the second set. The use of dual plenums 22 and 30 and dual manifolds in the bulkhead 10 allows local flame temperature to be controlled during part power operation. That is, the fuelair mixtures coming from the first and second stages can be different. For example, during part power operation the liquid manifolds in the first stage 28 can be set to provide a fuel-air mixture during part power operation that is rich enough in fuel to cause the neighboring second stage lean channels to ignite and consume the CO and unburned hydrocarbons that would otherwise be present. In full power operation, a fuel-air mixture close to the same, or the same, from both stages 28 and 36 would be utilized.

The liquid plenums 22 and 30 are positioned internally of the gas plenums 24 and 32 so that the gaseous fuel in the plenums 24 and 32 cools, by shielding the liquid fuel from the hot air passages 12 and 42, the liquid fuel in the plenums 22 and 30 and prevents coking.

The dual stages 28 and 36 shown in FIG. 4 can be arranged in a symmetric pattern as shown or they can be arranged in an asymmetric pattern. Arranging the manifold stages in an asymmetric pattern could be used as a means to break up combustion-acoustic coupling problems if they exist in a chosen application.

As shown in FIG. 4, the bulkhead also accommodates an ignitor 44 which is used to establish the flame in the combustion chamber during light-off. The ignitor 44 can be centrally positioned in, and passes through, the bulkhead into the combustion chamber. Its position must be located where a high fuel-air ratio exists in the combustor during ignition.

Figure 5:
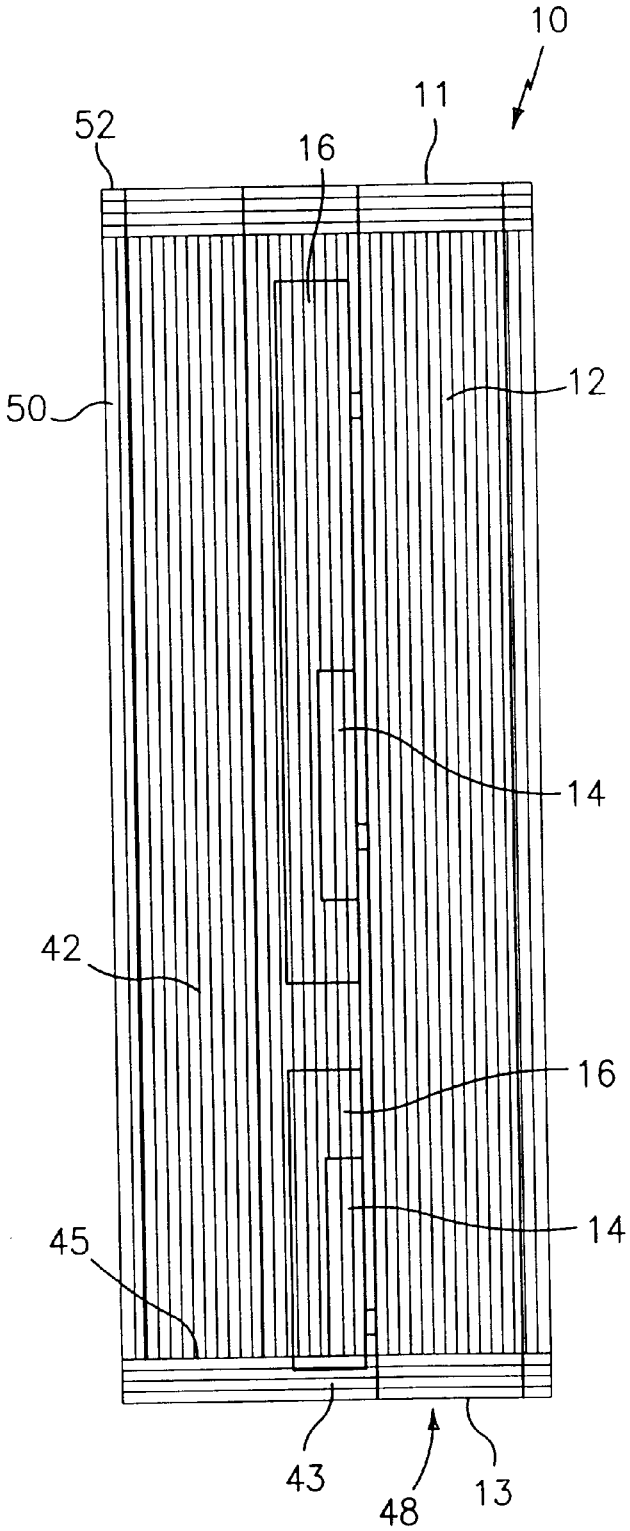
FIG. 5 is a sectional view of a bulkhead element in accordance with the present invention formed by a plurality of macrolaminate layers.

FIG. 5 illustrates a methodology for constructing a bulkhead element 10 in accordance with the present invention using macrolaminate, platelet, or similar technology. As shown therein, the bulkhead element 10 is constructed from a plurality of layers 50 and 52 of macrolaminate or platelet material. As can be seen from the figure, the layers 50 and 52 are arranged perpendicular to each other. The macrolaminate or platelet material used to form the bulkhead element 10 may be any suitable strong, hard, erosion resistant, etchable material. Such materials include metals, such as Inconel, and other commonly used materials in aeroengine and industrial gas turbine combustors. The layers 50 and 52 are etched to form the various components in the bulkhead element 10. The layers 50 and 52 may be etched using any suitable technique known in the art including but not limited to chemical and electrochemical techniques. For example, the macrolaminate or platelet material may be etched using a photo-sensitive resist and a ferric chloride etchant. The etching methods should follow best practices established by vendors capable of fabricating this device. Following etching, the etched layers 50 and 52 may be joined together using any suitable bonding technique known in the art such as brazing or diffusion bonding. The bonding methods should follow best practices established by vendors capable of fabricating this device.

As shown in FIG. 5, the etched macrolaminate or platelet layers 50 and 52 can be assembled to form the fuel-air channel 12 with its inlet 11 and exit 13, liquid fuel plenums or manifolds 14, gas plenums or manifolds 16, an air cooling passage 42, an impingement orifice plate 45, an air passage to discharge 43, and a combustor flame side plate 48. Any desired number of macrolaminate or platelet layers 50 and 52 can be used to form each bulkhead element 10 and the aforementioned structures.

The assembly technique mentioned herein is advantageous in that several different bulkhead designs can be constructed by creating building blocks where each building block has a mixing chamber 12, dual fuel supply plenums 14 and 16, and a cooling air access channel 42.

Figure 6:
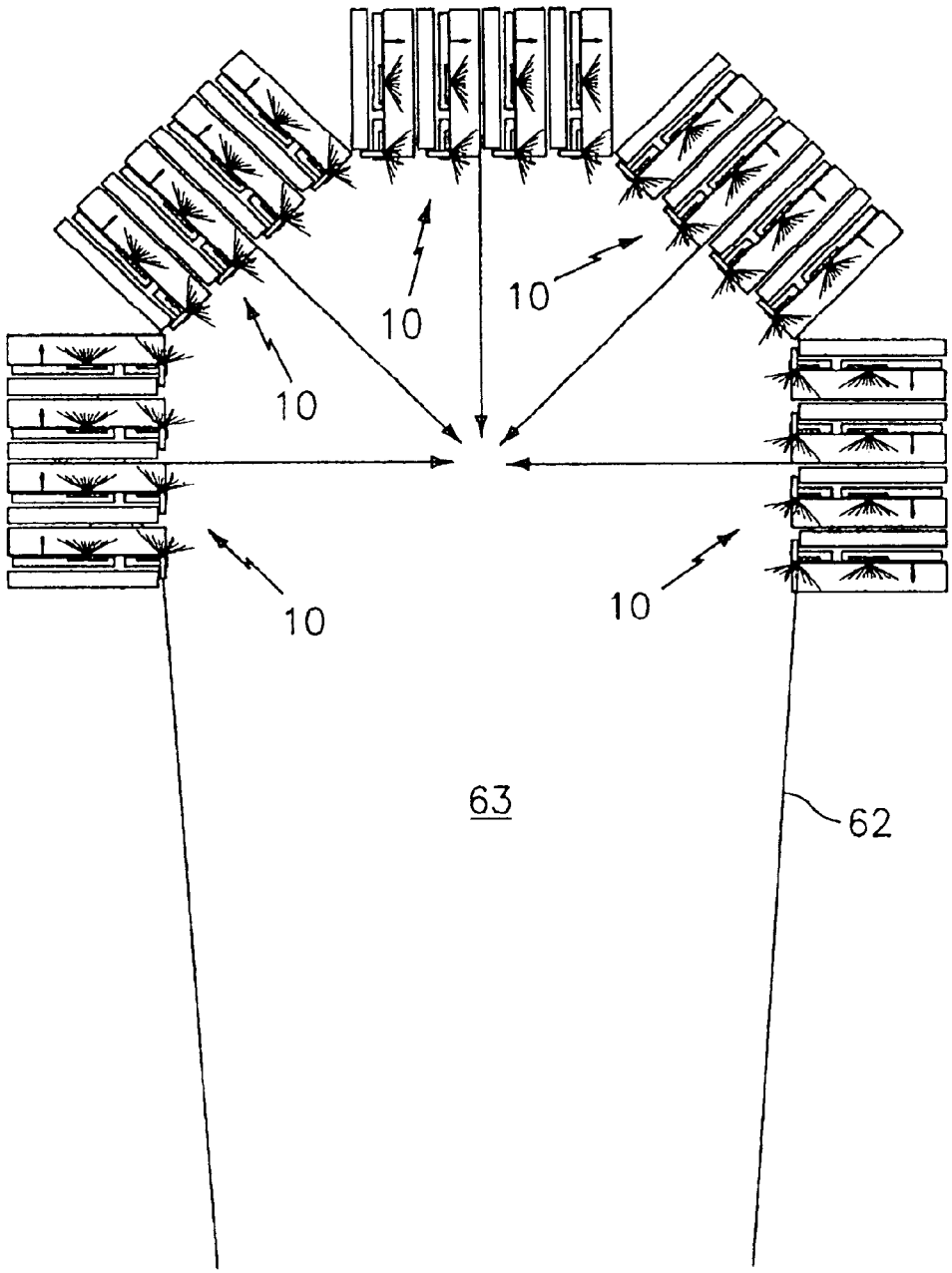
FIG. 6 is a side view of a bulkhead design for an annular combustor, which design is formed by a circumferential arrangement of a plurality of stacked bulkhead elements.

FIG. 6 is a side view of a first arrangement of bulkhead elements 10 for use in an annular combustor. As shown in this figure, the bulkhead is formed by a number of circumferentially arranged stacked bulkhead elements 10 with each stacked element 10 having a configuration such as that shown in FIGS. 1–3 or the dual stage configuration of FIG. 4. As can be seen from this figure, the elements 10 are arranged along a liner wall 62 of the combustion chamber 63.

Figure 7:
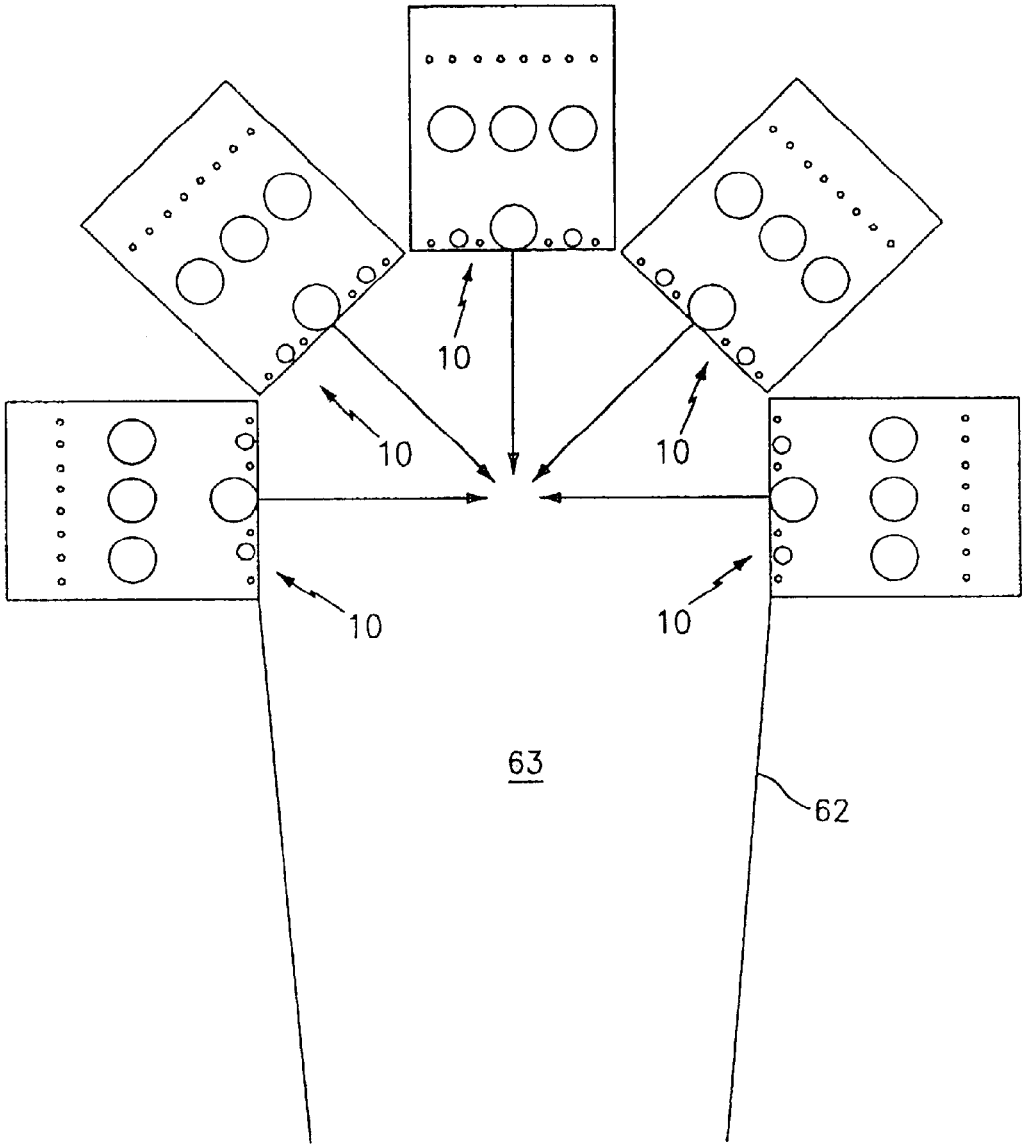
FIG. 7 is a side view of an alternative bulkhead design for an annular combustor, which design is formed by a radial arrangement of a plurality of stacked bulkhead elements.

FIG. 7 is a side view of a second arrangement of bulkhead elements 10 for use in an annular combustor. As can be seen from this figure, a number of stacked elements 10 are arranged along a liner wall 62 in a radial configuration. The stacked elements 10 in FIG. 7 are the same as those in FIG. 6 but rotated 90 degrees.

The arrangements shown in FIGS. 6 and 7 differ from the arrangement shown in FIGS. 4 and 8 in that the discharge plane of the fuel-air mixture is not maintained at a single elevation relative to the combustor liner wall as is done in the embodiments of FIGS. 4 and 8. In FIGS. 6 and 7, the mixing chamber arrangement causes the fuel-air mixture jets to collide with one another inside of the combustion chamber 63. This arrangement can further enhance the ignition, stability and emissions control offered by the system. Like the can arrangement in FIGS. 4 and 8, the annular combustor can also be arranged to discharge all of its elements 10 at a single elevation relative to the combustor liner wall.

FIG. 8 illustrates an alternative embodiment of.a bulkhead design having a first fuel stage 80 and a second fuel stage 82 for introducing a fuel-air mixture into a combustion chamber. In this embodiment, staggered fuel-air jets are used to enhance ignition, stability and emission control for a can system. The approach shown here is similar to the approach shown in FIG. 4, only the staggering of the fuel-air jets exiting the macrolaminate part is different. In this approach, the fuel-air jets exiting the premixer are positioned so that interaction is possible between jets of the same type. The staggered pattern permits jets to penetrate beyond their closest neighbor-mixing channel and interact with other jets further away. This pattern maximizes the interaction between fuel-air mixture jets in the combustion chamber originating from different sources. Similar fuel staging and jet staggering is possible for the annular combustor situations shown in FIGS. 6 and 7.

It is apparent that there has been provided in accordance with the present invention a bulkhead for dual fuel industrial and aeroengine gas turbines which fully satisfies the means, objects and advantages set forth hereinbefore. While the present invention has been described in the context of specific embodiments thereof, various modifications, alternatives, and variations will become apparent to those skilled in the art having read the foregoing description. Therefore, it is intended to embrace those modifications, alternatives, and variations as fall within the broad scope of the appended claims.

What is claimed is:

1. A bulkhead for use in a combustor system which comprises:

at least one bulkhead element;

said at least one bulkhead element having a fuel-air channel extending through said bulkhead element;

said fuel-air channel having an inlet for introducing air into said channel and an outlet for exiting a fuel-air mixture;

said at least on e bulkhead element further having at least one of a manifold for introducing a liquid fuel into said fuel-air channel and a manifold for introducing a gaseous fuel into said fuel-air channel; and said fuel-air channel and each said manifold being formed by a plurality of etched layers of material.

2. A bulkhead according to claim 1, wherein said at least one bulkhead element further comprises an air cooling channel formed from a plurality of etched macrolaminate or platelet layers.

3. A bulkhead according to claim 2, wherein said at least one bulkhead element further comprises an impingement orifice plate formed from at least one macrolaminate or platelet layer and an air discharge passage formed from a plurality of etched macrolaminate or platelet layers communicating with said air cooling channel for delivering cooling air to a surface of said bulkhead.

4. A bulkhead according to claim 1, further comprising an ignitor extending through said bulkhead.

5. A bulkhead for use in a combustor system which comprises:

at least one bulkhead element;

said at least one bulkhead element having a fuel-air channel extending through said bulkhead element;

said fuel-air channel having an inlet for introducing air into said channel and an outlet for exiting a fuel-air mixture;

said at least one bulkhead element further having at least one manifold for introducing a liquid fuel into said fuel-air channel;

each said manifold for introducing a liquid fuel into said fuel-air channel having at least one atomizer for introducing said liquid fuel into said fuel-air channel in the form of droplets; and each of said fuel-air channel and said at least one manifold being formed by a plurality of etched layers of material.

6. A bulkhead according to claim 5, further comprising each said manifold for introducing a liquid fuel into said fuel-air channel being positioned within another manifold formed from a plurality of etched layers of macrolaminate or platelet material.

7. A bulkhead according to claim 6, wherein said another manifold comprises a manifold for supplying a gaseous fuel to said fuel-air channel.

8. A bulkhead according to claim 7, wherein said gas supplying manifold includes a gas injection device.

9. A bulkhead according to claim 7, wherein said at least one bulkhead element further comprises at least one pilot for said liquid fuel and said gaseous fuel.

10. A bulkhead for delivering a fuel-air mixture to a combustion chamber of a gas turbine engine comprising:

a first stage for delivering a fuel-air mixture to said combustion chamber when said engine is being operated at full power and at partial power and a second stage for delivering a fuel-air mixture to said combustion chamber when said engine is being operated at full power and at partial power;

said first stage including a first gas plenum, a first liquid fuel plenum position inside of said first gas plenum, and a first set of air channels;

said first liquid fuel plenum communicating with a first set of liquid fuel manifolds for delivering liquid fuel to said air channels for creating a first fuel-air mixture when said engine is being operated at said full power and said partial power;

gaseous fuel in said first gas plenum cooling said liquid fuel in said first liquid fuel plenum so as to prevent coking;

said second stage including a second gas plenum, a second liquid fuel plenum positioned inside of said second gas plenum, and a second set of air channels;

said second liquid plenum communicating with a plurality of liquid fuel manifolds for delivering liquid fuel to said second set of air channels to create a second fuel-air mixture which is delivered to said combustion chamber at said full power and said partial power operation of said engine; and gaseous fuel in said second gas plenum cooling said liquid fuel in said second liquid plenum so as to prevent coking.

11. A bulkhead for delivering a fuel-air mixture to a combustion chamber of a gas turbine engine comprising:

a first stage for delivering a fuel-air mixture to said combustion chamber when said engine is being operated at full power and at partial power and a second stage for delivering a fuel-air mixture to said combustion chamber when said engine is being operated at full power and at partial power;

said first stage including a first gas plenum, a first liquid fuel plenum positioned inside of said first gas plenum, and a first set of air channels;

said first gas plenum and said first liquid plenum being exterior to said first set of air channels;

said first liquid fuel plenum communicating with a first set of liquid fuel manifolds for delivering liquid fuel to said air channels for creating a first fuel-air mixture when said engine is being operated at said full power and said partial power;

said second stage including a second gas plenum, a second liquid fuel plenum positioned inside of said second gas plenum, and a second set of air channels;

said second liquid plenum and said second gas plenum being exterior to said second set of air channels;

said second liquid plenum communicating with a plurality of liquid fuel manifolds for delivering liquid fuel to said second set of air channels to create a second fuel-air mixture which is delivered to said combustion chamber at said full power and said partial power operation of said engine; and said first and second gas plenums, said first and second liquid plenums, said first and second sets of air channels, and said liquid manifolds each being formed from a plurality of etched macrolaminate or platelet material layers.

12. A bulkhead according to claim 11, further comprising a plurality of air cooling channels positioned between said first and second stages.

13. A bulkhead according to claim 12, wherein said air cooling channels are each formed from a plurality of etched macrolaminate or platelet material layers.

14. A bulkhead according to claim 11, further comprising a centrally positioned ignitor or an ignitor placed near an appropriate fuel-air channel where the fuel-air mixture is high during ignition.

15. A bulkhead for an annular combustor comprising:

a plurality of stacked bulkhead elements positioned along a wall of said annular combustor;

each of said stacked bulkhead elements comprising a fuel-air channel extending through said element and having an inlet for introducing air into said channel and an outlet for exiting a fuel-air mixture;

each of said stacked bulkhead elements further comprising at least one manifold for introducing a liquid fuel into said fuel-air channel; and each stacked bulkhead element being formed from a plurality of etched macrolaminate or platelet layers bonded together.

16. A bulkhead according to claim 15, further comprising each of said stacked bulkhead elements including a manifold for introducing a gaseous fuel into said fuel-air channel.

17. A bulkhead according to claim 16, further comprising each of said stacked bulkhead elements including an air cooling channel for cooling a surface of said bulkhead.

18. A bulkhead according to claim 15, wherein said fuel-air jets exiting each of said stacked elements collide with each other in said combustion chamber.

19. A bulkhead according to claim 15, wherein the bulkhead elements are staggered to allow jets from the same stage to interact.

* * * * *